US007883620B2

(12) United States Patent
Owen

(10) Patent No.: US 7,883,620 B2
(45) Date of Patent: Feb. 8, 2011

(54) FILTER TRAP FOR WASTE WATER

(76) Inventor: Jonathan Owen, 19 Balfour Road, Southport, Merseyside (GB) PR8 6LE ( * ) Notice: Subject to any disclaimer, the term of this patent is extended or adjusted under 35 U.S.C. 154(b) by 624 days.

(21) Appl. No.: 11/936,185

(22) Filed: Nov. 7, 2007

(65) Prior Publication Data

US 2008/0210607 A1 Sep. 4, 2008

(51) Int. Cl.
*B01D 35/027* (2006.01)

(52) U.S. Cl. ..... 210/86; 210/91; 210/455; 210/497.01; 210/234

(58) Field of Classification Search ..... 210/85, 210/86, 91, 234, 235, 474, 477, 455, 484, 210/497.01, 497.3
See application file for complete search history.

(56) References Cited

U.S. PATENT DOCUMENTS 1,746,274 A * 2/1930 Otis, Jr. ..... 210/234
6,231,762 B1 * 5/2001 Marshall, III ..... 210/234
7,153,417 B2 12/2006 Happel

* cited by examiner

*Primary Examiner*—Terry K Cecil
(74) *Attorney, Agent, or Firm*—Roger N. Chauza, P.C.

(57) ABSTRACT

A filter trap into which waste water can be dumped to separate particulate matter from the water. A sensor senses when the liquid level in the filter trap rises above a predetermined level, and triggers an alarm to indicate the filter basket is full of particulate matter and must be removed to dispose of the contents. The withdrawal of the filter basket from the filter trap causes the inlet thereto to automatically close so that waste water cannot be dumped into the filter trap when the filter basket has been removed. A sensor senses when the filter basket has been removed to provide a visual indication thereof.

16 Claims, 7 Drawing Sheets

FILTER TRAP FOR WASTE WATER

TECHNICAL FIELD OF THE INVENTION

The present invention relates in general to filters, and more particularly to filters utilized to remove particulate matter from liquids.

RELATED APPLICATION

This non-provisional patent application claims the benefit of pending U.K. provisional application No. 0622112.1, filed Nov. 7, 2006, the disclosure of which is hereby incorporated herein by reference.

BACKGROUND OF THE INVENTION

The disposal of waste water and other fluids is a concern to many commercial establishments and businesses. In the normal course of producing a finished product or food item, a byproduct is often waste water that has particulate matter therein. Many restaurants, for example, can generate hundreds of gallons of waste liquids each day that often have particles of food and other items therein. As another example, coffee shops generate wastes during the course of a day, including spent coffee grounds that often find their way into the waste water that is allowed to drain away with other liquids. Restaurants and pasta shops often inadvertently allow the remnants of pasta and other food articles to be flushed down the drain in the kitchen. It is well known that rice and pasta have an affinity for attachment to the plumbing pipes and accumulate over time to the extent that a blockage occurs.

The disposal of particulate matter down the waste water drain often leads to a clogged drain, and if not more, the contamination of the city and municipal waste water disposal facilities. Temporary efforts to keep drains clean can involve the use of harsh chemicals which are usually only marginally effective, and which can damage the drain pipes over time. Moreover, the drain pipes and traps of restaurants and the like can become clogged by the particulate matter and require plumbers to remove the material. This is not only expensive, but requires a temporary outage of the plumbing system. A clogged drain in a food processing facility can also affect sanitary conditions, which may be closely scrutinized by sanitation inspectors and the like. The license to operate a food-related establishment can be jeopardized.

From the foregoing, it can be seen that a need exists for a prefilter system that filters particulate matter from liquids before being disposed of down a drain. Another need exists for a particulate filter that has plural inputs from plural drain sinks, or the like. A further need exists for a particulate filter having automatic input shut-off capabilities when the filter medium has been removed. An additional need exists for a filter in which the filter medium can be removed, cleaned and reinstalled without special tools. Yet another need exists for a filter having a sensor indicating when the filter medium has been removed, and when the water level in the filter container is above a predetermined level.

SUMMARY OF THE INVENTION

In accordance with the principles and concepts of the invention, there is disclosed a filter trap for removing particulate matter from waste water. The particulate matter filtered from the waste water is held within a filter basket. When the filter basket is removed from the filter trap, the inlet to the filter trap is automatically closed so that waste water with particulate matter cannot be drained into the filter trap.

In accordance with another feature of the invention, a sensor senses when the filter basket has been removed from the filter trap to provide a visual or audible indication thereof.

In accordance with yet another feature of the invention, when the filter basket becomes full of particulate matter, the water flow therethrough is slowed or stopped. When this occurs, a sensor senses when the liquid level within the filter trap rises above a predetermined level, and provides a visual or audible alarm.

In accordance with one embodiment of the invention, disclosed is a filter trap for removing particulate matter from a liquid. The filter trap includes a container having at least one inlet for input of a waste liquid that carries particulate matter, and includes an outlet. A filter medium is housed within the container for receiving the waste liquid. The filter medium allows liquid to pass therethrough but prevent the particulate matter from passing therethrough. A closure mechanism is movable from a first position in which the inlet is closed, and movable to a second position in which the inlet is open. The closure mechanism is biased to the closed position. The filter medium is engageable with the closure mechanism for moving the closure mechanism to the open position when the filter medium is inserted into the container In accordance with another embodiment of the invention, disclosed is a filter trap for removing particulate matter from a liquid. The filter trap includes a container having at least one inlet for input of a waste liquid that carries particulate matter, and includes an outlet. A filter basket is housed within the container for receiving the waste liquid. The filter basket has perforations to allow liquid to pass therethrough but prevent the particulate matter from passing therethrough. The filter basket has an open top and has a bottom that is slanted to a lowest level. A closure mechanism is movable from a first position in which the inlet is closed, and movable to a second position in which the inlet is open. The closure mechanism is biased to the closed position. The filter basket is engageable with the closure mechanism for moving the closure mechanism to the open position when the filter basket is inserted into the container.

With regard to yet another embodiment of the invention, disclosed is a method of constructing a filter trap. The method includes fabricating a container for the filter trap, and fabricating the container with one or more inlets for draining waste liquids into the container to be filtered. The container is fabricated with a lid covering an opening therein, and the lid is moveable from a first position in which the opening is covered to a second position in which the opening is open. The filter basket is further fabricated for filtering particulate matter from waste liquid drained into the filter trap, and fabricated with a size so as to be moved through the opening in the container. A closure mechanism is fabricated for closing off the one or more inlets when the filter basket is removed from the container, and for opening the inlets when the filter basket is located within the container and the lid is closed.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
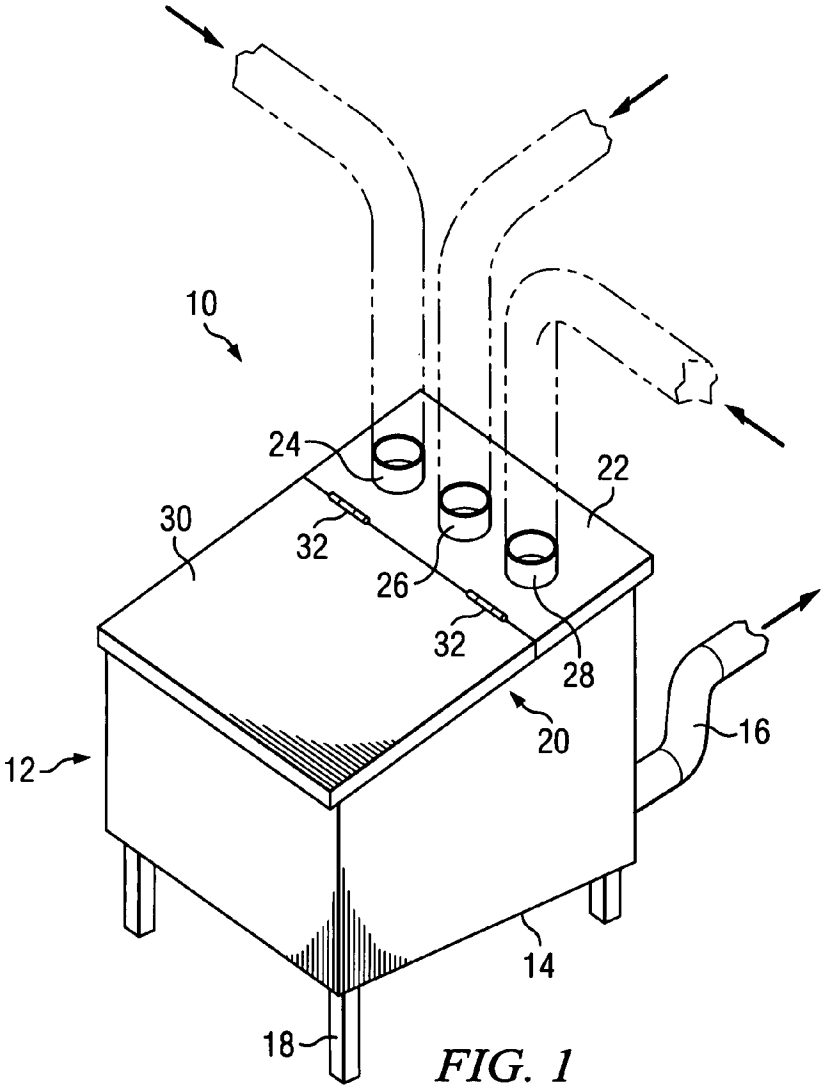
FIG. 1 is an isometric view of a filter trap constructed according to the invention.

With reference to FIG. 1, there is illustrated the filter trap 10 constructed according to an embodiment of the invention. The filter trap 10 includes a container 12 constructed of stainless steel, or other material that is corrosion resistant, such as a synthetic material. The container 12 includes four sides and a bottom 14. The bottom 14 slants from the front of the container 12 to the back of the container 12. The slanted bottom 14 allows filtered liquids to drain to the back of the container 12 where an outlet 16 is located. The outlet 16 of the filter trap 10 is piped to a floor or other drain of the facility. Four legs, one shown as numeral 18, support the container 12 above the floor. Because of the backward-slanted bottom 14 of the container 12, the back legs are shorter than the front legs.

The container 12 includes a top 20 that is generally horizontal. The top 20 of the container 12 is constructed in two parts. A stationary or fixed top part 22 is fastened to the respective opposing sides of the container 12 and the back side of the container 12. Formed in the top of the stationary top 22 are one or more inlets 24, 26 and 28. The inlets 24, 26 and 28 can be constructed of metal or PVC plastic to match the plumbing material of the facility. Importantly, the plural inlets 24, 26, and 28 can service a corresponding number of sinks or other disposal facilities of the user of the filter trap 10. The filter trap 10 thus serves as a collection point of the plural disposal facilities. Of course, those skilled in the art can adapt the filter trap 10 of the invention to service as many disposal facilities as needed. The container 12 of the filter trap 10 can be fabricated with volumes and sizes for large industrial uses, to smaller sizes for under the counter restaurant and kitchen applications.

Figure 2:
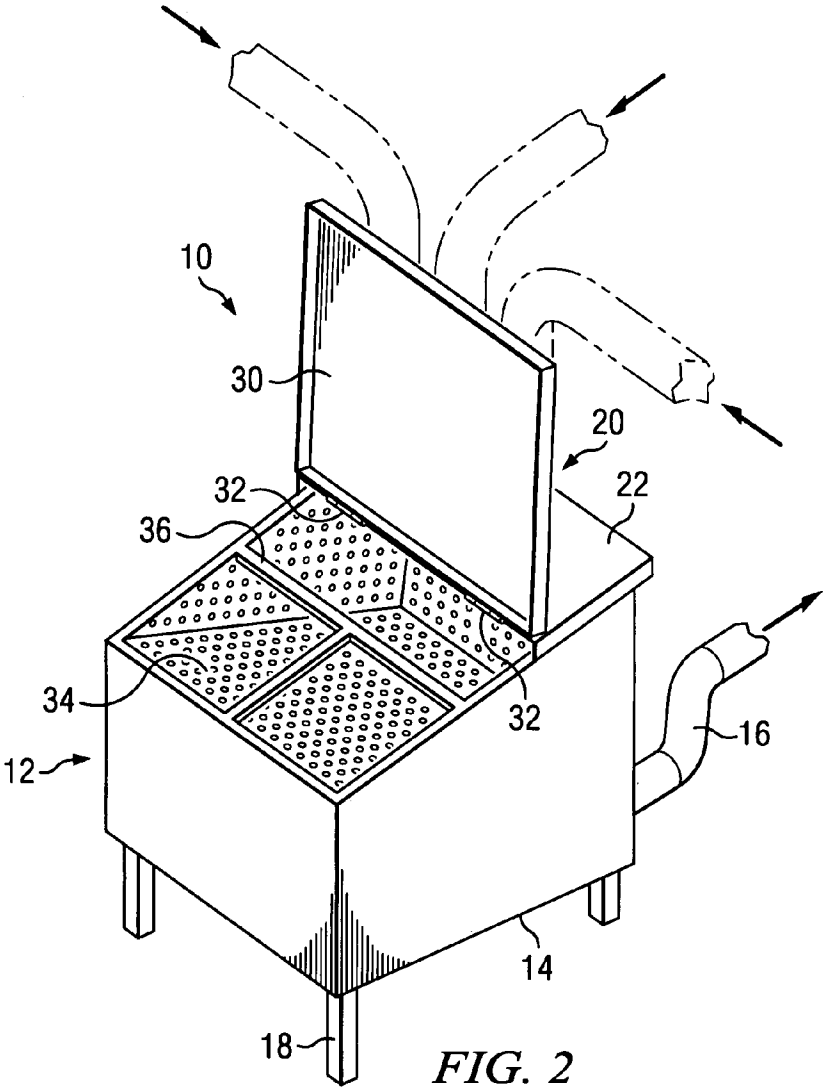
FIG. 2 is an isometric view of the filter trap with the lid open to access the filter basket.

The top 20 of the container 12 also includes a hinged or movable lid 30 with a flange therearound to provide rigidity thereto. The hinged lid 30 is preferably hinged at the back thereof to the fixed top 22. In this manner, the lid 30 can be pivoted to the open position as shown in FIG. 2 to allow access to the internal components of the filter trap 10. The hinges are shown as numeral 32. Preferably, a single, long piano-type hinge is employed to join the hinged lid 30 to the stationary top 22.

With specific reference to FIG. 2, the movable lid 30 is hinged to the open position to allow access to the filter basket 34. The filter basket 34 is constructed of perforated metal, and preferably a screen material to prevent debris from escaping therefrom. The water and debris coupled to the container 12 via the inlets 24, 26 or 28 are separated so that the liquid passes through the perforations in the filter basket 34, and the particulate matter is trapped therein. In accordance with an important feature of the invention, the basket 34 can be easily removed from the container 12 through the open top 30 so that the debris can be disposed of in the proper manner, and the basket 34 cleaned and returned to the container 12. To that end, the filter basket 34 includes a handle 36 for grasping and lifting it out of the container 12. While the handle 36 is illustrated as a lateral member across the top of the filter basket 34, the handle 36 can also be of other constructions, such as a wire bail. With the construction of the filter trap 10, no special tools or equipment is required to remove the filter basket 34 from the container 12, and reinstall the same therein.

Figure 3:
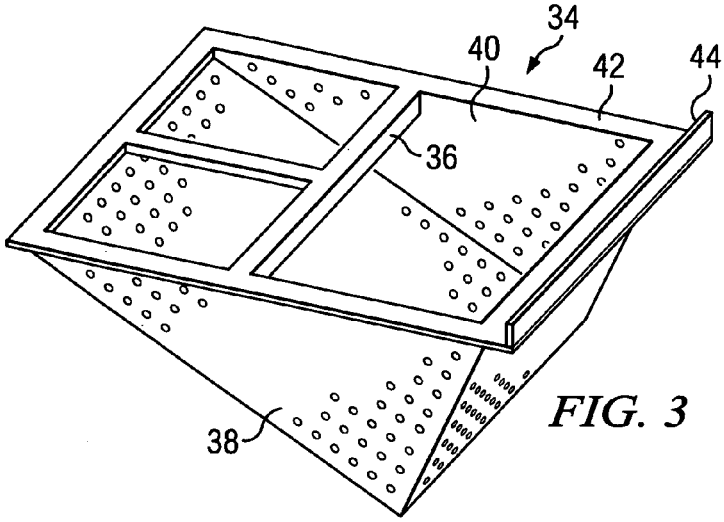
FIG. 3 is an isometric view of the filter basket constructed according to the invention.

The filter basket 34 is shown in more detail in FIG. 3. Here, the filter basket 34 is shown constructed with a V-shaped configuration so that the particulate matter settles to the V-shaped bottom. All three sides and the slanted bottom of the filter basket are constructed with perforations or a screen medium so that liquid passes therethrough. When the filter basket 34 employs a screen material as the filter medium, a rigid frame is used for fastening the screen thereto. As can be appreciated, the size of the perforations relate to the size of particle to be trapped, it being realized that if coffee grounds are to be trapped, then smaller perforations are required, as compared to larger particles, such as pasta or rice. The planar, rectangular-shaped slanted bottom and the back of the filter basket 34 are perforated. The opposing triangular-shaped sides 38 and 40 of the filter basket 34 are generally vertical and are perforated also. The top of the filter basket 34 is open and includes a flange 42 therearound. Formed on the back portion of the flange 42 is an upright member 44, the purpose of which will be described below. While the filter basket 34 can be made with different sizes with respect to the container 12 in which it is housed, the filter basket 34 of the preferred embodiment is about 35-55% of the volume of the container 12, and preferably about 43%.

Figure 4:
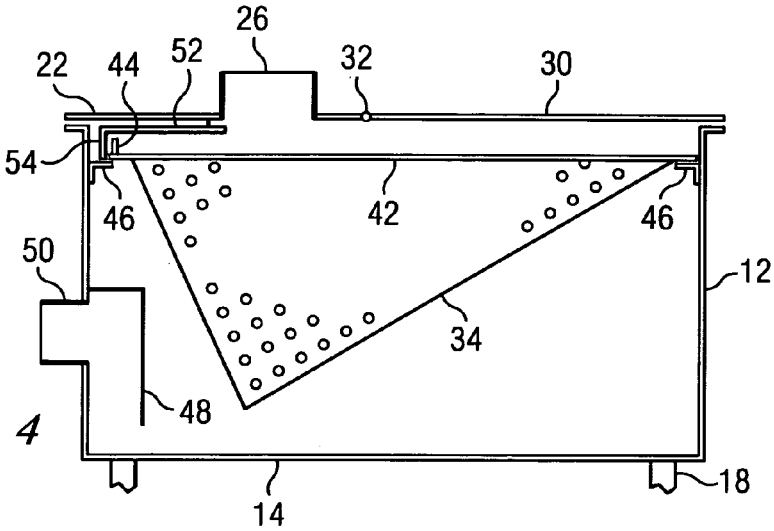
FIG. 4 is a cross-sectional view of the filter trap with the hinged lid closed.
Figure 5:
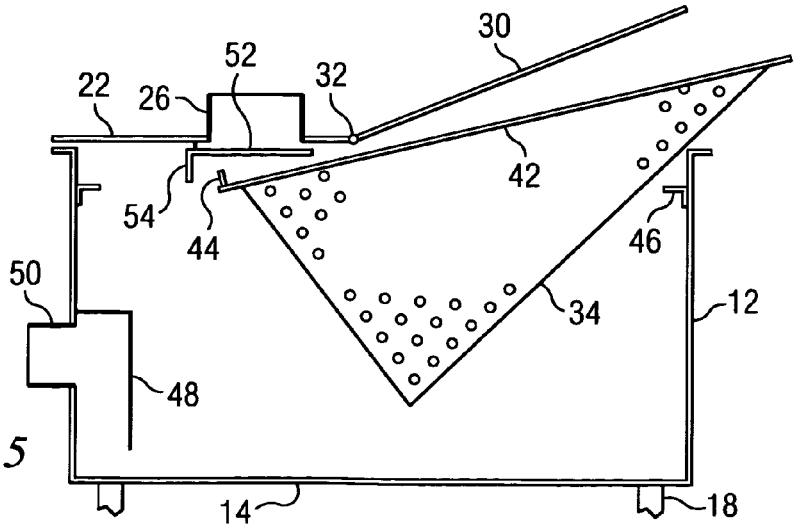
FIG. 5 is a cross-sectional view of the filter trap with the lid open and the filter basket partially removed from the container.

FIG. 4 illustrates the internal construction of the container 12 of the filter trap 10. An angle bracket 46 is fastened to all four inner sidewalls of the container 12. The angle bracket 46 functions as a rest on which the flange 42 of the filter basket 34 sits. The bottom of the filter basket 34 is thus elevated above the bottom 14 of the container 12. The opening in the container 12 formed when the hinged lid 30 is pivoted to the position shown in FIG. 5, is sufficient to allow removal of the filter basket 34 therethrough, without spilling the particulate matter trapped in the basket 34.

With reference back to FIG. 4, it can be seen that the inlet 26 is located in the stationary part of the lid 22 so as to be directly above the filter basket 34, and preferably above the deepest part of the basket 34. The liquid and particulate matter coupled from a restaurant sink or other facility is drained to the inlet 26 and into the filter basket 34. The liquid drains out of the filter basket 34 through the perforations and into the bottom portion of the container 12. From the container 12, the liquid passes under a shroud 48 and out of the drain pipe 50. A U-shaped coupling pipe can be connected to the drain pipe 50 to function as a conventional drain trap to hold liquid therein and prevent gasses and sewer fumes from passing through the floor drain into the filter trap 10.

In accordance with an important feature of the invention, the filter trap 10 is provided with an automatic shut-off mechanism to plug the inlets 24, 26 and 28 when the filter basket 34 is removed from the container 12. With this arrangement, unfiltered waste liquid is prevented from being dumped into the container 12 and thus into the bottom thereof when the filter basket 34 has been removed. A closure plate 52 is effective to move under the inlets 24, 26 and 28 and close off the respective entrances into the container 12. As can be appreciated, the closure plate 52 is slideable in spaced-apart tracks (not shown) from a position shown in FIG. 4 where the inlets 24, 26 and 28 are open to the container 12, to a closed position shown in FIG. 5 where the inlets 24, 26 and 28 are closed off from the internal part of the container 12. The closure plate 52 slides in a pair of tracks fastened to the underside of the stationary lid 22. The closure plate 52 is biased to the closed position shown in FIG. 5 by any suitable mechanism, such as one or more springs, or a counter balance, etc. The closure plate 52 includes a downwardly depending member 54 attached to the bottom surface thereof.

When the filter basket 34 is initially inserted into the container 12, the upright member 44 located on the back of the filter basket flange 42 engages the downwardly depending member 54 of the closure plate 54, thus pushing the closure plate 54 toward the back of the container 12. This is illustrated in FIG. 4. The backward movement of the closure plate 54 is effective to open the inlets 24, 26 and 28 of the container 12. As can be appreciated, the closure of the inlets 24, 26 and 28 is generally transparent to the user, as the installment of the filter basket 34 automatically moves the closure plate 54 from the closed inlet position to the open inlet position.

When the filter basket 34 is full of particulate matter, it can be removed from the container 12 by hinging the movable lid 30 to the open position, grasping the handle 36 of the filter basket 34 and withdrawing it through the container opening, as shown in FIG. 5. As the filter basket 34 is withdrawn, the spring-loaded closure plate 52 moves forwardly with the upright member 44 of the filter basket 34. The forward movement of the closure plate 54 is effective to automatically close the inlets 24, 26 and 28 to the container 12. If an attempt is made to drain liquids with particulate matter into the filter trap 10 when the filter basket 34 is not present, the liquids and particulate matter will be stopped by the closure plate 54 and held within the inlet pipes coupled to the inlets 24, 26 and 28 of the filter trap 10. The wastes held in the inlet pipes will be maintained until the filter basket 34 is again installed in the container 12. Importantly, the engagement of the filter basket 34 with the closure plate 54 is such that at least a portion of the filter basket 34 is under the inlets 24, 26 and 28 when the closure plate 54 begins to move to the open position. This prevents any of the wastes temporarily held in the inlet pipes from draining into the bottom of the container 12 without being filtered when installing the filter basket 34 in the container 12.

Figure 6:
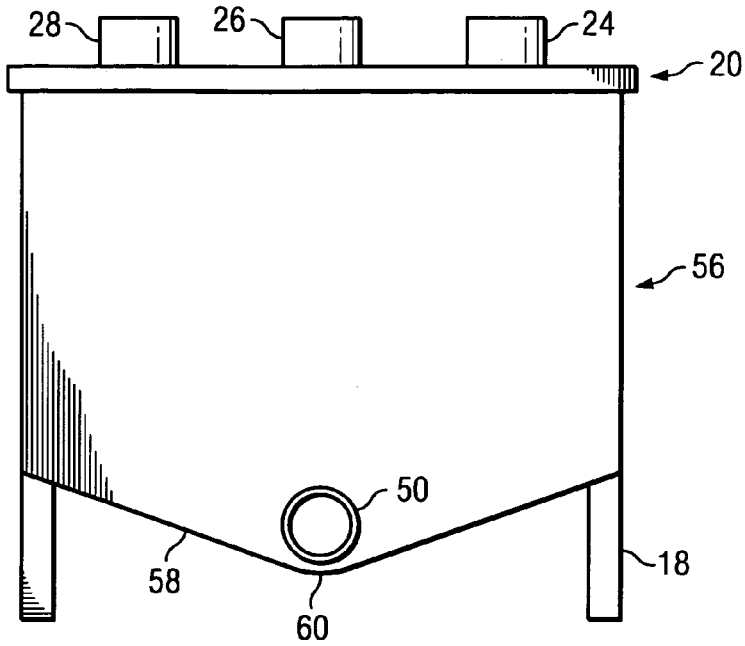
FIG. 6 is a back view of another embodiment of a container with which the filter trap of the invention can be employed.

With reference to FIG. 6, there is illustrated another embodiment of a container 56 having a bottom 58 that slants downwardly from the sides toward a trough-like bottom 60. The outlet 50 is located at the back of the container 56 at the bottom of the trough-like bottom 60. This facilitates the complete draining of liquids out of the container 56. In this embodiment, the bottom 58 of the container 56 can still slant to the back of the container 56. Other container configurations can be provided to achieve the various results desired.

Figure 7:
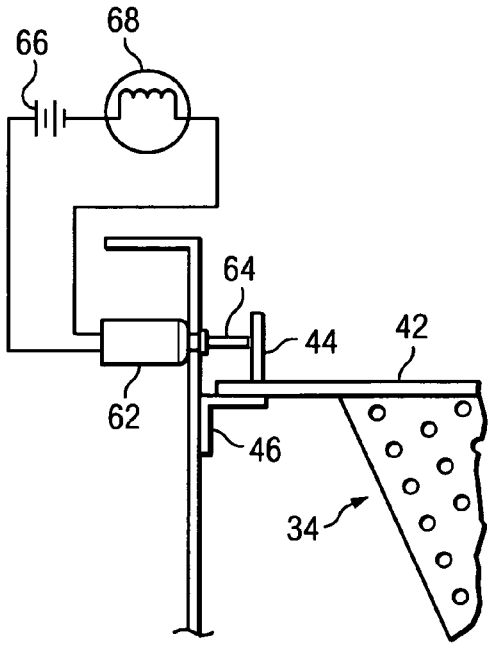
FIG. 7 is a diagram of a portion of the filter trap illustrating the details of a sensor for sensing when the filter basket has been removed from the container.

In various situations, it may advantageous to know when the filter basket 34 has been removed from the container 12. FIG. 7 illustrates a sensor 62 for sensing such a situation. The sensor 62 includes an internal set of contacts that are open when the plunger 64 is pushed into the body of the sensor 62, and closed when the plunger 64 is allowed to be extended. Thus, when the filter basket 34 is installed in the container 12 in the manner shown, the switch contacts are open and no current flows therethrough. When the filter basket 34 is removed from the container 12 to empty the particulate matter therefrom, the plunger 64 is spring loaded and extends outwardly to close the internal contacts. The switch 62 is mounted to the container 12 at a location to allow the spring-loaded plunger 64 to be actuated by some surface or edge of the filter basket 34. The electrical conductors of the switch 62 are connected to a battery 66 or power supply which is in series with a lamp 68 or other visual or audible indicator. Thus, when the filter basket 34 has been removed form the container 12, the lamp 68 lights and provides an indication to personnel that the filter trap 10 is unavailable for use. Other types of sensors can be utilized, including magnetic proximity switches, optical switches, etc., to sense the presence of the filter basket 34 within the container 12.

Figure 8:
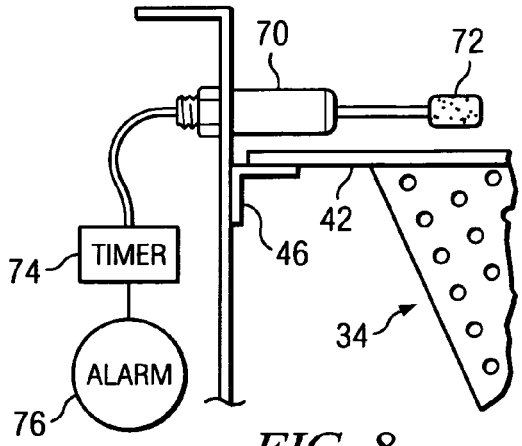
FIG. 8 is a diagram of a portion of the filter trap illustrating the details of a sensor for sensing when the level of the liquid in the container has exceeded a predetermined level.

FIG. 8 illustrates a sensor 70 for sensing the level of liquid in the container 12. It may be important to be aware when the level of the liquid in the container 12 remains above a predetermined level for a specified period of time. In other words, if the filter basket 34 is full of particulate matter, then the perforations in the sides of the filter basket 34 will be covered and will not allow the liquid to drain therethrough in a timely manner. In this situation, the waste water will rise to a level above the filter basket 34. This condition is remedied by removal of the filter basket 34 and disposal of the particulate matter.

The sensor 70 includes a float 72 situated at a location in the container 12 to sense when the waste water has reached a predetermined level. FIG. 8 illustrates that such level is above the filter basket 34. When the waste water rises to such level, meaning the filter basket 34 is full of particulate matter, the float 72 will rise and close a switch in the sensor 70. The closure of the sensor switch triggers a timer 74 which may be set for 10-15 seconds, or other suitable time. If the switch closure in the sensor 70 is not extinguished within the timer period, then the timer 74 will drive an alarm 76 to indicate the filter basket 34 is full and requires disposal of the particulate matter. The delay timer 74 prevents an alarm condition in those cases where the liquid level in the container 12 temporarily rises above the predetermined level for a time less than that of the delay timer 74, and then drops due to slow draining of the liquid through the perforations in the filter basket 34. This condition can exist when the filter basket 34 is 90-95% full of particulate matter. The alarm 76 can be a visual or audible signal located adjacent the filter trap 10, or remotely therefrom, or both. The timer 74 may be of the type which remains triggered once the time period has elapsed and thereafter the liquid drops below the predetermined level. In other words, even though the liquid level drops after elapse of the timer period, the alarm 76 will remain triggered until manually reset, such as by reinsertion of the filter basket 34 into the container 12.

The sensors 62 and 70 can also be connected to a monitor for monitoring the conditions in the environment of the facility. The monitor could be a computer or other processor-controlled system which maintains a record of the number of times the sensors 62 and 70 have sensed the respective conditions. Reports can be generated for supervisory personnel as to the operation and present conditions of the various filter traps employed.

Figure 9:
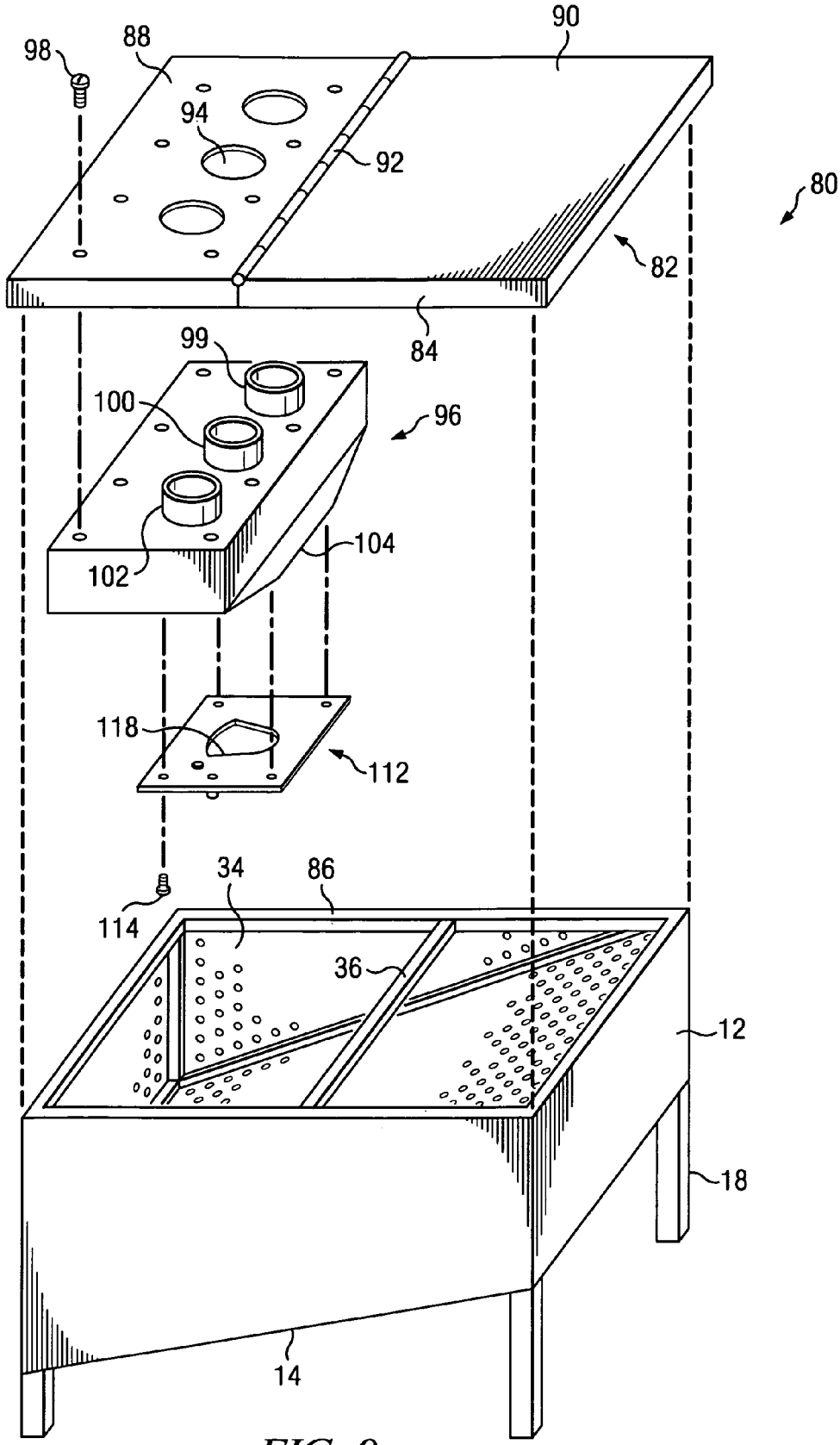
FIG. 9 is an exploded view of another filter trap constructed according to the invention.

FIG. 9 illustrates a filter trap 80 according to another embodiment of the invention. The various components of the filter trap 80 are shown removed for purposes of clarity. The container 12 includes a slanted bottom 14 and legs 18 much like that described above. A filter basket 34 is shown resting in the container 12. A two-part lid 82 includes a flange 84 which is adapted for fitting over the top edge 86 of the container 12. The two-part lid 82 includes a stationary part 88 that is fixed to the top of the container 12 by any suitable means, such as screws (not shown). A movable lid part 90 is hinged to a frontal edge of the stationary lid part 88 by long hinge 92. The stationary lid 88 includes three circular inlet openings, one shown as numeral 94.

Figure 10A:
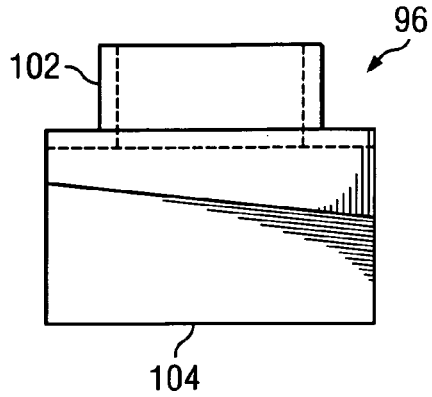
FIGS. 10*a*, 10*b* and 10*c* are respective side, frontal and top views of a three-inlet collection manifold of the invention.
Figure 10B:
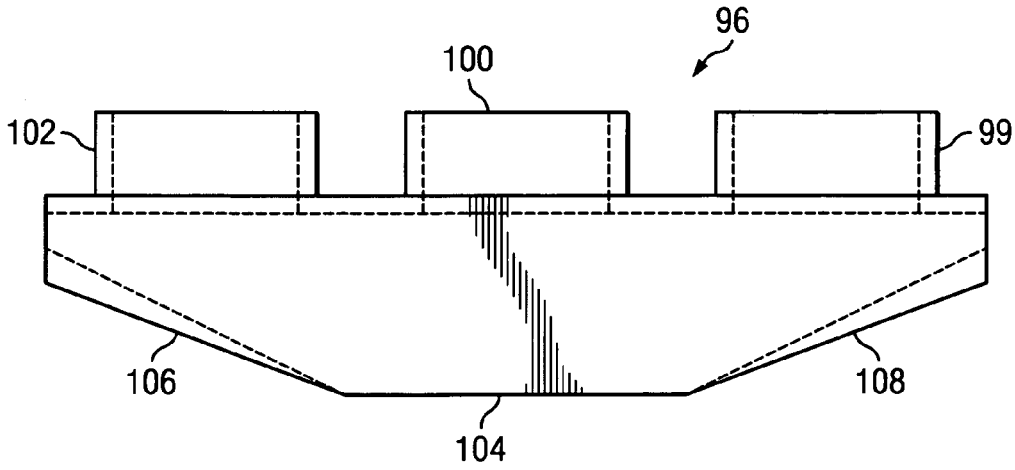
Figure 10C:
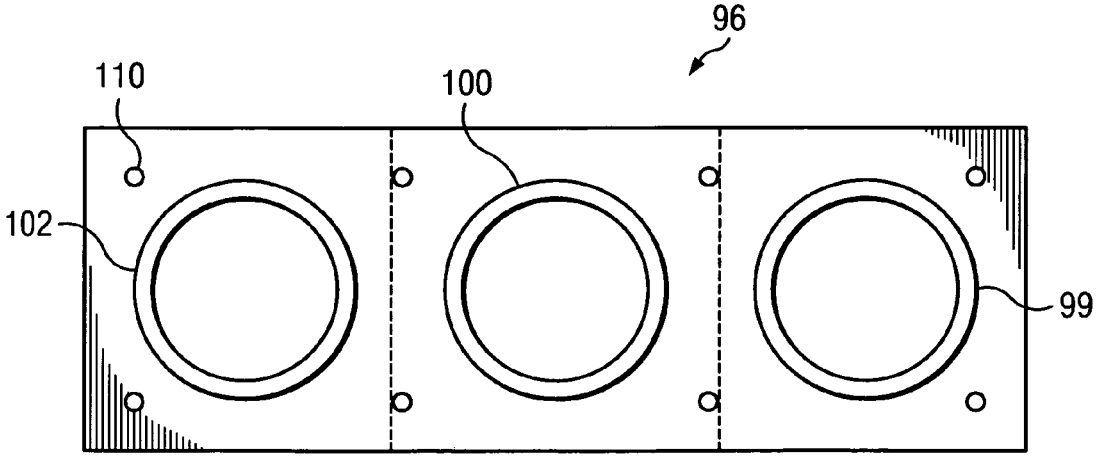
Figure 11A:
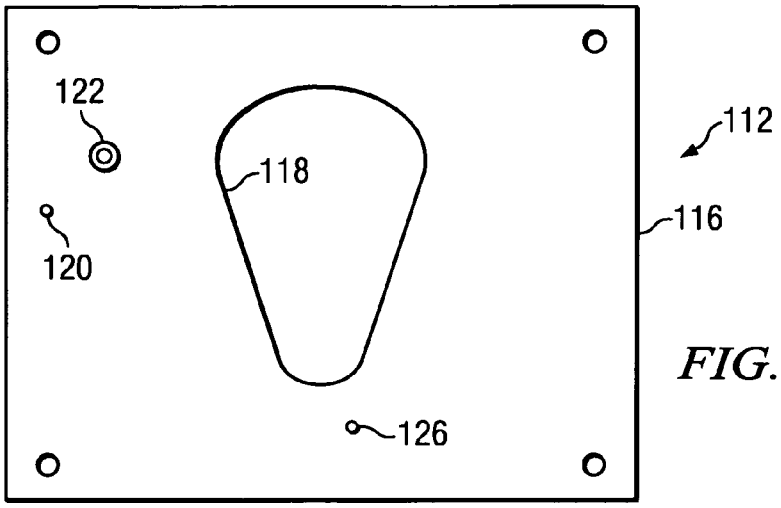
FIGS. 11*a* and 11*b* are respective top and side views of a closure plate.
Figure 11B:
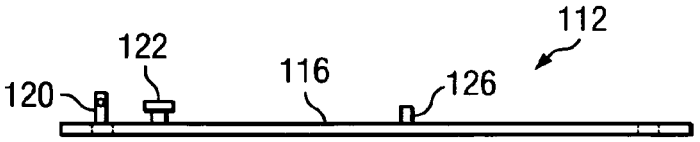
Figure 12A:
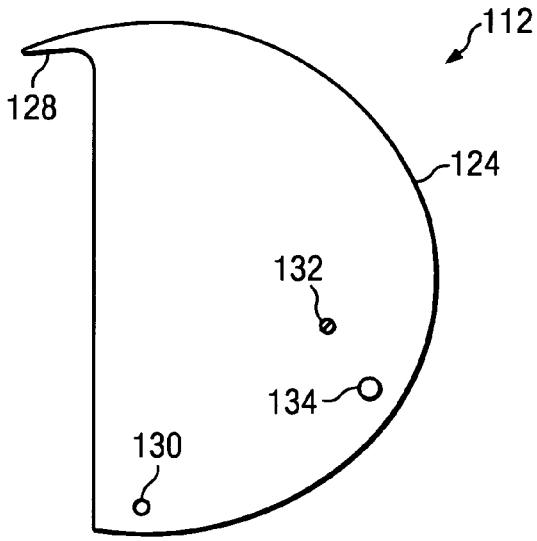
FIGS. 12*a* and 12*b* are respective top and side views of a pivotal closure member.
Figure 12B:
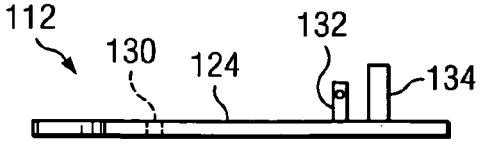

A collection manifold 96 is adapted for mounting under the stationary lid 88 and fixed thereto by a number of screws, one shown as numeral 98. The collection manifold 96 is shown in more detail in FIGS. 10*a*-10*c*. The collection manifold 96 functions to collect the waste liquids input thereto via the three tubular inlets 99, 100 and 102 and funnel the same to a single outlet 104 located on the bottom of the manifold 96. Two bottom portions 106 and 108 are slanted toward the bottom opening 104, which is square. The three tubular inlet 99, 100 and 102 protrude through the circular openings in the stationary part 88 of the lid 82. The tubular inlets 99, 100 and 102 are adapted for connection to the plumbing drain pipes of a kitchen sink or other facility. The top of the manifold 96 includes a number of threaded holes 110 into which the fastening screws 98 are threaded.

In accordance with an important feature of the invention, the collection manifold 96 includes a closure mechanism for closing the bottom thereof when the filter basket 34 has been removed therefrom. Shown in FIG. 9, and in more detail in FIGS. 11*a* and 11*b*, and FIGS. 12*a* and 12*b*, is the closure mechanism 112. The closure mechanism 112 is fastened over the bottom, square opening 104 in the manifold 96 by a number of screws 114. The closure mechanism 112 includes a closure plate 116 with a teardrop-shaped opening 118 formed therein. A spring anchor pin 120 is attached to the underside of the closure plate 116. The anchor pin 120 can have a hole therein for insertion of the end of a spring. Fastened also to the underside of the closure plate 116 is a stop member 122 against which a pivotal closure member 124 (FIGS. 12*a* and 12*b*) abuts when in a closed position. Lastly, attached to the bottom side of the closure plate 116 is a pin 126 around which the closure member 124 pivots from a closed position for completely covering the teardrop-shaped opening 118, to an open position in which the opening 118 is unobstructed and waste water passes therethrough and into the filter basket 34.

The closure member 124 is generally semicircular with a lug 128. The opening 118 in the closure plate 116 can be shaped other than shown, and the closure member 124 can be shaped other than shown. The closure member 124 includes a pivot hole 130 formed therein. The pin 126 of the closure plate 116 is inserted into the pivot hole 130 of the closure member 124. With this arrangement, the closure member 124 can be pivoted between the open position and the closed position with respect to the opening 118 in the closure plate 116. Attached to the bottom of the closure member 124 is a pin 132 with a hole therein for anchoring a spring therein. Also attached to the bottom of the closure member 124 is a push pin 134. The push pin 134 can be pushed by the filter basket 34 during insertion into the container 12 and pivot the closure member 124 from the closed position to the open position.

Figure 13A:
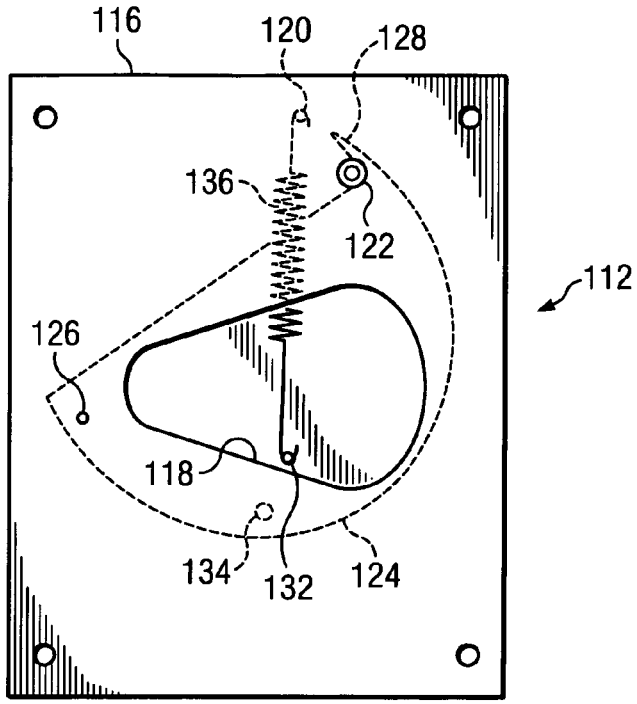
FIG. 13*a* is a top view of the closure assembly, with the closure member shown in broken line, and shown covering the opening in the closure plate.

With reference now to FIG. 13*a*, there is illustrated the closure assembly 112 with the closure member 124 pivotally attached to the closure plate 116, and with the closure member 124 in a closed position covering the opening 118 in the closure plate 116. A spring 136 is shown with an end anchored to the pin 120 in the closure plate 116, and another end anchored to the pin 132 in the closure member 124. The spring 136 is effective to pull or pivot the closure member 124 to a position covering the opening 118 in the closure plate 116. This is the situation when the filter basket 34 has been removed from the container 12. In the closed position, the closure member 124 is spring tensioned against the stop pin 122. As noted above, should waste water with particulate matter therein be drained into the manifold 96, the waste liquid will remain generally in the manifold 96 and will not be freely drained into the bottom of the container 12. While the closure member 124 need not provide a water tight seal to the closure plate 116, the engagement therebetween should be sufficient so as to prevent particulate matter from leaking between the closure member 124 and the closure plate 116 when the former is closed. Those skilled in the art may desire to provide a water tight seal between the plate 116 and the member 124 using rubber or plastic seals.

Figure 13B:
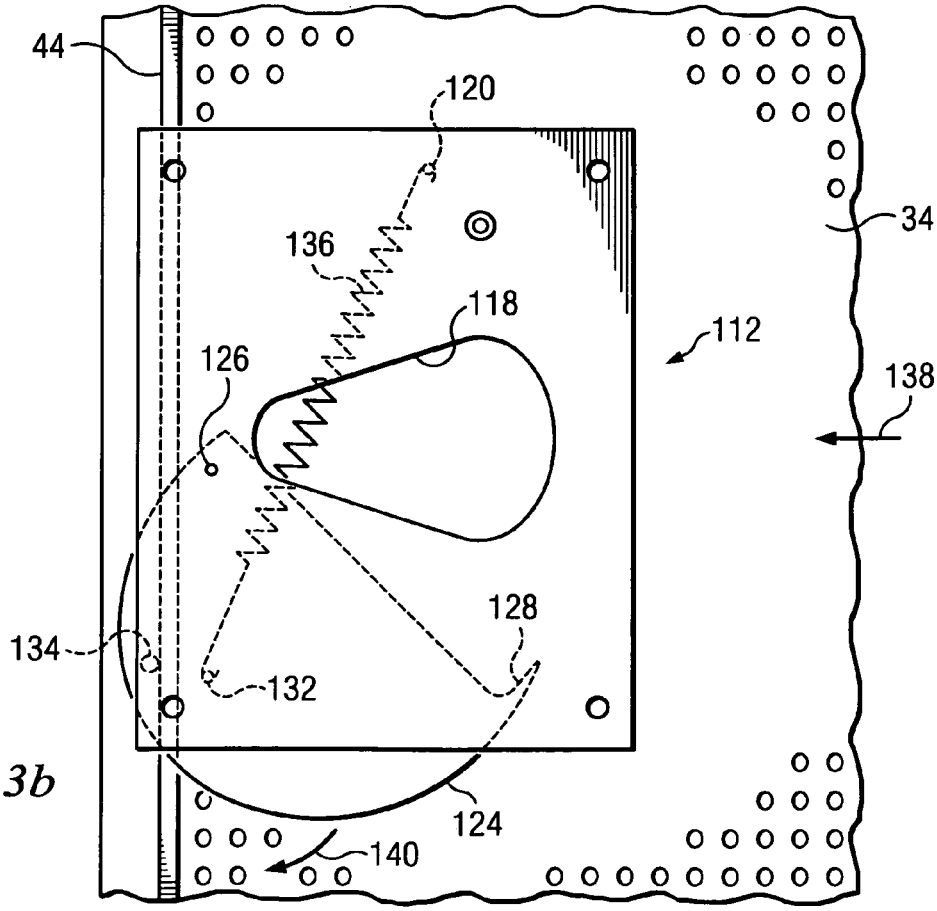
FIG. 13*b* is a top view of the closure assembly, with the closure member shown closing the opening in the closure plate.

FIG. 13*b* illustrates the closure assembly 112 when the filter basket 34 is being installed into the container 12. As noted above, the filter basket 34 includes an upright member 44 located adjacent the back part of the basket 34. When the filter basket 34 is being inserted into the container 12 in the direction shown by arrow 138, the upright member 44 engages the downwardly depending push pin 134 of the closure member 124 and pushes it forwardly. This pivots the closure member 124 about pin 126 and moves it against the spring tension in the direction of arrow 140. The continued pivotal movement of the closure member 124 by the upright member 44 of the filter basket 34 is effective to completely uncover the opening 118 in the closure plate 116. This is shown in FIG. 13*b*. As can be appreciated, when the filter basket 34 is moved in the opposite direction to remove it from the container 12, the spring biased closure member 124 follows the movement of the upright member 44 of the filter basket 34 until the opening in the closure plate 116 is completely closed.

From the foregoing, disclosed is a filter trap having a filter basket that can be easily removed to dispose of the particulate matter. According to another feature, the inlets to the container automatically close when the filter basket is removed. Sensors can be utilized to sense when the filter basket has been removed, and when the liquid in the container reaches a predetermined level, meaning that the filter basket is substantially full of particulate matter.

While the preferred and other embodiments of the invention have been disclosed with reference to a specific filter trap, and associated methods thereof, it is to be understood that many changes in detail may be made as a matter of engineering choices without departing from the spirit and scope of the invention, as defined by the appended claims.

What is claimed is:

1. A filter trap for removing particulate matter from a liquid, comprising:

a container having at least one inlet for input of a waste liquid carrying particulate matter, said container also having an outlet;

a filter medium housed within said container beneath said inlet for receiving the waste liquid, said filter medium allowing liquid to pass therethrough but preventing the particulate matter from passing therethrough, said filter medium comprising an open top defined by a peripheral flange;

a closure mechanism positioned within said container adjacent said inlet and movable laterally from a first position in which said inlet is closed to a second position in which said inlet is open, said closure mechanism biased to said closed position and including a downwardly depending member; and said filter medium peripheral flange engaging said downwardly depending member to move said closure mechanism laterally to said open position when said filter medium is inserted into said container.

2. The filter trap of claim 1, wherein said closure mechanism is spring biased.

3. The filter trap of claim 1, wherein said container includes a hinged lid adapted for hinging to an open position to remove said filter medium from said container.

4. The filter trap of claim 3, wherein said hinged lid is hinged to a fixed top portion of said container, said fixed top portion having formed therein said inlet.

5. The filter trap of claim 4, wherein said fixed top portion includes plural inlets.

6. The filter trap of claim 1, wherein said filter medium is a filter basket constructed with a V-shaped bottom.

7. The filter trap of claim 6, wherein said filter basket is constructed having a shallow depth at a front thereof, and a bottom which slants to a back of said filter basket so that the back of the filter has a greater depth than said front.

8. The filter trap of claim 1, wherein said filter medium is a filter basket suspended above a bottom of said container.

9. The filter trap of claim 1, wherein said container is constructed with a bottom which slants downwardly from opposing sides to a center of said bottom, and said outlet is formed in a back panel of said container adjacent a lowest part of said bottom.

10. The filter trap of claim 1, wherein said container includes plural inlets, and said closure mechanism is operative to simultaneously open and close said inlets.

11. The filter trap of claim 1, further including a sensor for sensing when said filter medium has been removed from said container, and said sensor is operative to generate a sensory indication thereof.

12. The filter trap of claim 1, further including a sensor for sensing when a liquid level in said container has reached a predetermined level, and said sensor is operative to generate a sensory indication thereof.

13. The filter trap of claim 12, further including a delay timer for generating said sensory indication after said liquid level remains at said predetermined level for a predefined delay time.

14. A filter trap for removing particulate matter from a liquid, comprising:

a container having at least one inlet for input of a waste liquid carrying particulate matter, said container also having an outlet;

a filter basket housed within said container beneath said inlet for receiving the waste liquid, said filter basket having a filter medium to allow liquid to pass therethrough but preventing the particulate matter from passing therethrough, said filter basket having an open top defined by a peripheral flange and having a bottom that is slanted to a lowest level;

a closure mechanism positioned within said container adjacent said inlet and movable laterally from a first position in which said inlet is closed to a second position in which said inlet is open, said closure mechanism biased to said closed position and including a downwardly depending member; and said filter basket peripheral flange engaging said downwardly depending member to move said closure mechanism laterally to said open position when said filter basket is inserted into said container.

15. The filter trap of claim 14, wherein said filter basket includes four filter surfaces, including a planar rectangular-shaped bottom, a planar rectangular back, and opposing planar triangular-shaped sides.

16. The filter trap of claim 14, wherein the lowest level of said filter basket is located directly below said inlet.

* * * * *